United States Patent [19]

Cary

[11] Patent Number: 4,646,444

[45] Date of Patent: Mar. 3, 1987

[54] BOW SIGHT

[76] Inventor: John W. Cary, 2350 Milford Rd., Milford, Mich.

[21] Appl. No.: 803,384

[22] Filed: Nov. 29, 1985

[51] Int. Cl.[4] ..... F41G 1/46

[52] U.S. Cl. ..... 33/265

[58] Field of Search ..... 33/265, 261; 124/87

[56] References Cited

U.S. PATENT DOCUMENTS

| | | | |
|---|---|---|---|
| 2,788,701 | 4/1957 | Browning | 33/265 |
| 3,368,282 | 2/1968 | Gibson et al. | 33/265 |
| 3,524,440 | 8/1970 | Hill | 33/265 |
| 3,861,051 | 1/1975 | Killian | 33/265 |
| 4,178,693 | 12/1979 | Smith | 33/265 |
| 4,555,856 | 12/1985 | Brown | 33/265 |

*Primary Examiner*—Willis Little

*Attorney, Agent, or Firm*—Gifford, Groh, VanOphem, Sheridan, Sprinkle & Dolgorukov

[57] ABSTRACT

The present invention provides an archery sight having an elongated housing which is secured to the bow. A first opening extends through the front and rear sides of the housing while a second opening is longitudinally positioned from the first opening and is only opened to the front side of the bow. A planar mirror is secured along one side of the first opening within the housing and a parabolic mirror is contained within the housing and aligned with the second opening. The other side of the first opening is transparent so that a split image is viewed through the first opening. Both the parabolic mirror and the planar mirror are arranged so that when the halves of the split image viewed through the first opening are aligned, the bow is properly aimed.

6 Claims, 7 Drawing Figures

BOW SIGHT

BACKGROUND OF THE INVENTION

I. Field of the Invention

The present invention relates generally to sights and, more particularly, to a sight for a low speed projectile, such as an arrow fired from a bow.

II. Description of the Prior Art

As is well known in the art, in the sport of archery, the bow is cocked by the archer and, upon release, projects the arrow forwardly of the bow. Furthermore, since the bow is typically cocked to the same position each time the arrow is fired, the arrow is initially fired along a predetermined path of travel and at a predetermined initial and rather low speed. The arrow follows a generally parabolic path after it is fired and until it hits its target or the earth.

A major difficulty in the sport of archery is the degree of elevation of the bow necessary to obtain the desired distance for the arrow. There have been a number of previously known bow sights which, when calibrated, provide the archer with the proper elevation of the bow over a wide range of distances. Such previously known sights are acceptable when shooting targets at predetermined or known distances.

A major disadvantage of these previously known bow sights, however, is that they require that the archer determine the distance between himself or herself and the target prior to firing the arrow. When shooting game with bow and arrow, however, the distance between the archer and the target can only be approximated so that these previously known sights provide only an approximation of the necessary elevation for the bow in order to hit the game. Since these previously known bow sights provide only an approximation when used for shooting game, many archers simply disregard them altogether and shoot using their own natural instincts rather than a bow sight.

SUMMARY OF THE PRESENT INVENTION

The present invention provides a split image bow sight which overcomes all of the above mentioned disadvantages of the previously known devices.

In brief, the bow sight of the present invention provides an elongated housing having a front side, a rear side and an interior housing chamber. The housing is secured to the bow so that its rear side faces the archer while its front side faces in the direction of travel for the arrow when fired.

A first opening in the housing extends through both housing sides and is open to the housing chamber. Conversely, a second housing opening is open only to the front side of the housing at a position longitudinally spaced from the first opening and this second opening is also open to the housing chamber.

A parabolic mirror is contained within the housing chamber in alignment with the second housing opening. This parabolic mirror is arranged to reflect incoming light through the second housing opening downwardly through the interior of the housing and towards the first opening. Similarly, a planar mirror is diagonally arranged across one side of the first opening so that light reflected longitudinally through the housing by the parabolic mirror is reflected by the planar mirror rearwardly through the first opening and towards the archer. The other side of the first opening, however, is transparent so that light passes directly through this other half of the first opening from the target to the archer.

In practice, the archer, by looking through the first housing opening, views an image which is split along a vertical center line. One side of the image represents the image as reflected by the parabolic and planar mirrors while the other side of the image represents the straight line of sight between the archer and the target. By adjusting the elevation of the bow, the reflected half of the split image will vertically slide due to the reflection from the parabolic mirror. Once both sides of the image are aligned with each other, the proper elevation for the bow is obtained so that, when fired, the arrow will strike the target. Furthermore, one can adjust the bend or shape of the parabolic mirror to calibrate the sight for different archers and different bows.

BRIEF DESCRIPTION OF THE DRAWING

A better understanding of the present invention will be had upon reference to the following detailed description when read in conjunction with the accompanying drawings, wherein like reference characters refer to like parts throughout the several views and in which.

DETAILED DESCRIPTION OF A PREFERRED EMBODIMENT OF THE INVENTION

Figure 1:
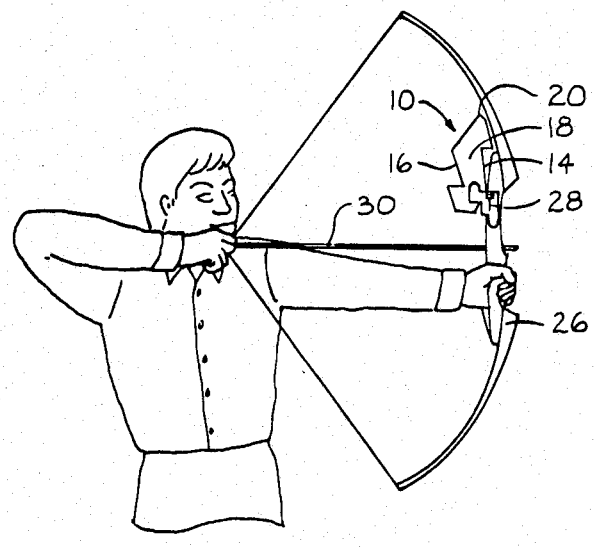
FIG. 1 is a side view illustrating a preferred embodiment of the present invention.
Figure 2:
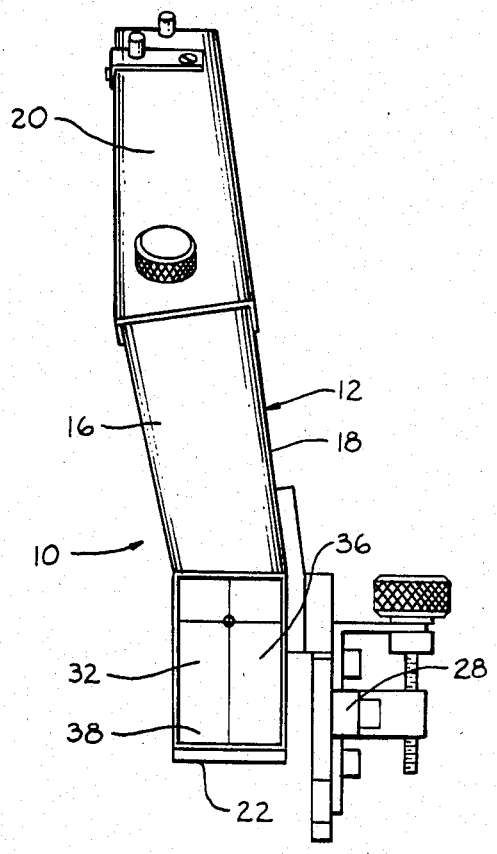
FIG. 2 is a plan view showing the rear side of the preferred embodiment of the invention.
Figure 3:
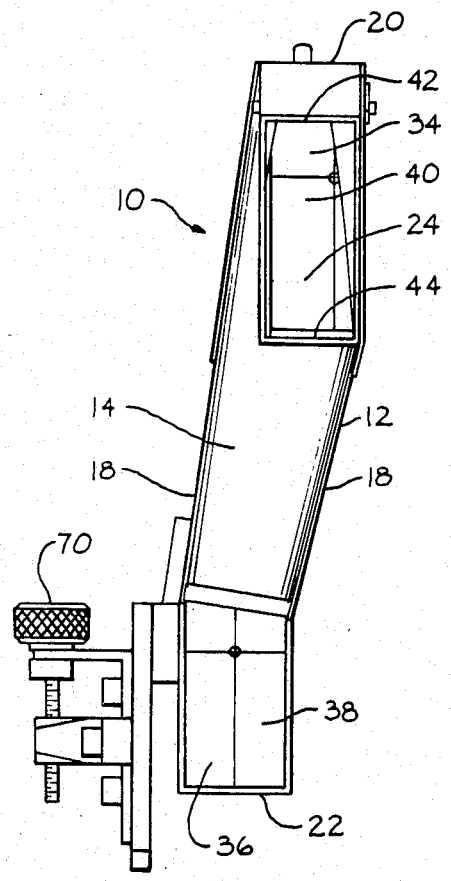
FIG. 3 is a plan view showing the front side of the preferred embodiment of the invention.

With reference first to FIGS. 1–3, a preferred embodiment of the bow sight 10 of the present invention is thereshown and comprises a vertically elongated housing 12 having a front side 14, a rear side 16, two lateral sides 18, a top 20 and a bottom 22. All sides 14–18 of the housing 12 are relatively thin walls so that the housing 12 defines an interior chamber 24.

As best shown in FIG. 1, the housing 12 is secured to an archery bow 26 by any conventional means, such as a bracket 28, so that the front side 14 of the housing 12 faces the direction of trajectory of an arrow 30 fired by the bow 26 while the rear side 16 faces rearwardly towards the archer using the bow 26. In addition, the housing 12 is secured to the bow 26 so that the housing 12 extends generally vertically along the bow 26, and thus perpendicular to the direction of travel of the arrow 30.

With reference now particularly to FIGS. 2 and 3, an opening 32 is formed through the housing 12 adjacent its bottom 22 so that the opening 32 is open to both the front side 14 and rear side 16 of the housing 12 as well as the housing chamber 24. Similarly, a second opening 34 (FIG. 3) is formed in the housing 12 adjacent its top 20 and this opening 34 is also open to the housing chamber 24. Unlike the lower opening 32, however, the opening 34 is open only to the front side 14 of the housing 12.

Figure 4:
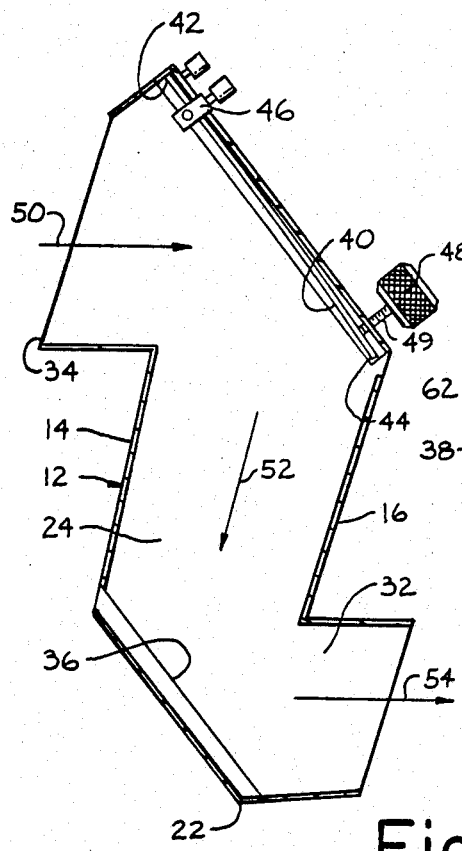
FIG. 4 is a side view of the preferred embodiment of the invention and with parts removed for clarity.

With reference now to FIGS. 2–4, a planar mirror 36 is attached to the housing 12 so that it extends diagonally (see FIG. 4) across the lower opening 32. This planar mirror 36, however, extends across only the right hand side, as viewed in FIG. 2, of the lower opening 32. The left side 38 of the opening 32 (as viewed in FIG. 2) is transparent thus allowing unobstructed vision between the archer and the target. Consequently, a split image of the target is viewed by the archer through the opening 32.

Referring now particularly to FIGS. 3 and 4, a second mirror 40 is secured to the housing 12 so that the mirror 40 extends generally diagonally with respect to the axis of the housing 12 and is aligned with the second housing opening 34. Unlike the planar mirror 36, however, the mirror 40 is curved in the shape of a parabola from its forward end 42 and towards its rearward end 44 for a reason to be shortly described.

Although any means can be employed to form the parabolic mirror 40, in the preferred form of the invention, the mirror 40 is preferably formed of a slightly flexible material, such as thin glass, having a reflective surface on one side, which is attached to the housing 12 at a fulcrum point 46 adjacent one end. The mirror 40 narrows linearly in width from its front end 42 and towards its rearward end 44 (FIG. 4). A knob 48 having a threaded shaft 49 is threadably mounted in a hole in the housing 12 and the shaft 49 abuts against the mirror 40 adjacent its rearward end 44. Consequently, by turning the knob 48, the amount of bend of the mirror 40 and thus the shape of the mirror 40 can be adjusted for a reason to be subsequently described. Furthermore, the degree of curvature or the amount of bending of the mirror 40 increases from the front side 14 of the housing 12 and to its rear side 16.

With reference now to FIG. 4, both the planar mirror 36 and the parabolic mirror 40 are angled generally diagonally with respect to the axis of the housing 12. Consequently, light passing through the upper housing opening 34 as shown by arrow 50 is reflected by the parabolic mirror 40 generally longitudinally through the housing chamber 24, as shown by arrow 52. This light ultimately is reflected by the planar mirror 36 rearwardly through the lower housing opening 32, as shown by arrow 54, towards the archer.

All projectiles which are fired along a predetermined path of travel and with a predetermined initial velocity travel along a predetermined parabolic curve. Consequently, by matching the curve of the parabolic mirror 40 to the characteristics of the archer by adjustment of the knob 48, and thus the shape of the mirror 40, the reflective image from the parabolic mirror 40 via the planar mirror 36 can be matched to the shooting characteristics of the archer and/or bow.

Figure 5:
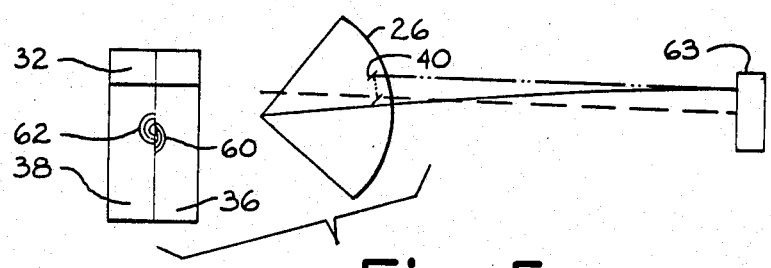
FIGS. 5–7 are diagrammatic views illustrating the operation of the preferred embodiment of the invention.

For example, with reference to FIG. 5, the elevation of the bow 26 is initially too high. When this occurs, the non-reflected image half 62 of the target 63 as seen through the side 38 of the opening 32 is positioned above the reflected image half 60 of the target 63, i.e., the image of the target 7 as reflected by the mirrors 40 and 36.

Figure 6:
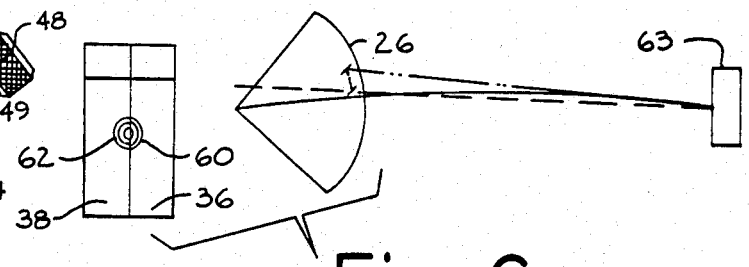

By lowering the elevation of the bow to the position shown in FIG. 6 so that the image halves 60 and 62 of the target 63 are aligned with each other as viewed by the archer through the opening 32, the bow 26 is properly aimed. Consequently, once the bow is fired, the arrow will strike the target 63 as represented by the image halves 60 and 62 as desired.

Figure 7:
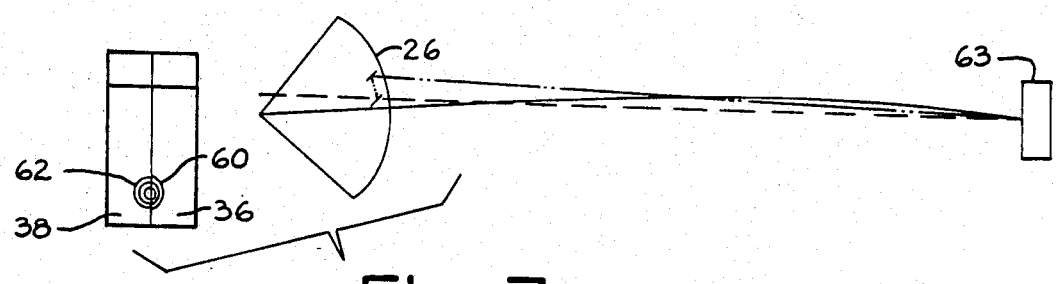

Similarly, in FIG. 7 the elevation of the bow 26 is also properly adjusted so that the image halves 60 and 62 are aligned with each other. In this case, the image halves 60 and 62 align at a lower position in the opening 32, as contrasted with FIG. 6, since the target 63 is positioned further from the archer. Furthermore, in all cases, the reflected image half 60 is more vertically elongated than the non-reflected half 62 of the target 63.

As best shown in FIG. 1, the bow sight 10 is preferably mounted to the bow 26 so that the sight 10 is nested behind the bow limb. This mounting minimizes tangling or snarling of the bow sight 10 on tree branches, shrubbery and the like when in use. Furthermore, as shown in FIGS. 2 and 3, the housing 12 is angled so that the upper end of the bow sight 10 is positioned to one side of the bow limb while a portion of the lower end is nested behind the bow limb.

Although the present invention has been described for use in conjunction with archery, it will be understood that it is equally adaptable to other low speed projectiles which are fired at a predetermined initial velocity and along a predetermined path of travel. Consequently, the present invention is easily adaptable to short range artillery and the like.

Having described my invention, however, many modifications thereto will become apparent to those skilled in the art to which it pertains without deviation from the spirit of the invention as defined by the scope of the appended claims.

I claim:

1. For use in conjunction with a weapon of the type which fires a projectile towards a target along a predetermined path of travel and at a predetermined initial speed, a sight for setting the elevation of the weapon comprising:

an elongated housing having a forwardly facing side and a rearwardly facing side, a first opening extruding through said housing sides, and open to said sides of said housing, and a second opening open to said forward side of said housing, said second opening being longitudinally spaced from said first opening, means for securing said housing to the weapon so that said housing extends substantially transversely of said path of travel and so that said first opening is substantially parallel to said path of travel, a planar mirror mounted to said housing between the ends of and along one side of said first opening, said planar mirror being angled with respect to said path of travel so that light traveling longitudinally through said housing is reflected by said planar mirror through the other end of said first opening and substantially parallel to said path of travel, wherein the other side of said first opening is transparent thus allowing a non-reflected image to pass therethrough, and a parabolically curved mirror mounted within said housing in alignment with said second opening, said curved mirror being angled with respect to the path of travel so that light entering said second opening along said path of travel is reflected longitudinally through said housing towards said planar mirror, said curved mirror having a degree of curvature which increases parabolically from the forwardly facing side of the housing and to the rearwardly facing side of the housing so that the curved mirror reflects an image of a target to said planar mirror which varies in position as a function of the distance between the target and the sight and the angle of the housing with respect to vertical so that said parabolic mirror reflects an image to said planar mirror in which the reflected and non-reflected images are automatically aligned when the elevation of the weapon is accurately aimed to fire the projectile at the target.

2. The invention as defined in claim 1 and comprising means for adjusting the degree of curvature of the curved mirror.

3. The invention as defined in claim 2 wherein said adjusting means comprises at least one threaded member threadably mounted to said housing and having one end in abutment with said curved mirror whereby rotation of said threaded member varies the curvature of said curved mirror.

4. The invention as defined in claim 1 wherein said sight is an archery bow sight.

5. The invention as defined in claim 1 wherein said mirrors both extend generally diagonally with respect to the longitudinal axis of said housing.

6. The invention as defined in claim 3 and comprising means for fixing a front end of said curved mirror to said housing and wherein said threaded member abuts against a rear end of said curved mirror.

* * * * *